US005762387A

United States Patent [19]

Edgerly et al.

[11] Patent Number: 5,762,387

[45] Date of Patent: Jun. 9, 1998

[54] UNIVERSAL LATCH

[75] Inventors: Jeffrey R. Edgerly, Bristol; Vincent A. Bove, Bethlehem, both of Conn.

[73] Assignee: The Stanley Works, New Britain, Conn.

[21] Appl. No.: 736,381

[22] Filed: Oct. 24, 1996

[51] Int. Cl.[6] ..... E05B 15/02

[52] U.S. Cl. ..... 292/357; 292/347; 292/DIG. 60

[58] Field of Search ..... 292/357, 356, 292/347, DIG. 60, DIG. 64, DIG. 53, 348; 70/451, 452

[56] References Cited

U.S. PATENT DOCUMENTS

| | | |
|---|---|---|
| 2,615,744 | 10/1952 | Colonna . |
| 2,642,302 | 6/1953 | Young . |
| 3,107,113 | 10/1963 | Sconzo . |
| 4,432,576 | 2/1984 | Wartian . |
| 4,456,290 | 6/1984 | Gross et al. . |
| 4,639,024 | 1/1987 | Crepinsek . |
| 5,092,144 | 3/1992 | Fleming et al. . |

FOREIGN PATENT DOCUMENTS

| | | | |
|---|---|---|---|
| 1049733 | 1/1959 | Germany | 292/356 |

*Primary Examiner*—Rodney M. Lindsey
*Attorney, Agent, or Firm*—Pepe & Hazard LLP

[57] ABSTRACT

A universal door latch is mounted on a door having a series of holes therethrough for a latch spindle and fasteners. The latch has first and second subassemblies, a spindle, and means to rotate the spindle. The first subassembly includes a first housing which is secured to one side of the door and has a recess in its inner surface in which is seated a track plate with a central aperture and elongated slots diametrically spaced from the aperture. A pair of mounting studs are slidably seated in the slots, and a ribbon spring couples the mounting studs to cause the studs remain equidistant during their sliding movement. The second subassembly includes a second housing which is secured to the other side of the door and has a recess in its inner surface in which is seated a mounting plate with a central aperture and elongated slots diametrically spaced from the aperture. A pair of fasteners is slidably seated in the slots and engaged with the studs of the first subassembly.

17 Claims, 3 Drawing Sheets

UNIVERSAL LATCH

BACKGROUND OF THE INVENTION

The present invention relates to door latches, and, more particularly, to a universally adjustable door latch which enables the position of the latch mounting studs to be adjusted relative to existing door latch mounting holes.

Latch assemblies are widely employed for installation on either newly manufactured doors or currently installed doors which require replacement of old door latches. On various doors, however, the distance between the latch mounting holes varies, and may vary from 1½ inches to 3 inches. As a result, the spacing between the non-adjustable mounting studs for door latches must be matched in size to existing door latch mounting holes. This limits the functional adaptability of door latches and requires multiple sizes of door latches to be inventoried. Alternatively, new holes may be drilled through the door to accommodate the new door latch mounting studs, but this is often time consuming and difficult, and sometimes may require filling of the existing holes to avoid overlapping.

Accordingly, it is an object of the present invention to provide a novel universal door latch having mounting studs adjustable in position relative to the spindle aperture.

It is also an object to provide such a latch in which the mounting studs are centered about the center line of the spindle throughout their full range of adjustability to facilitate installation.

Another object is to provide such a latch in which the adjustable studs are maintained in assembly so as to enable simple and rapid installation on a door.

Still another object is to provide such a latch which may be readily fabricated from economically produced component parts to produce a long lasting, rugged assembly.

SUMMARY OF THE INVENTION

It has now been found that the foregoing and related objects may be readily attained in a universal door latch which is mounted on doors having a series of holes therethrough for a latch spindle and fasteners. The latch comprises first and second subassemblies, a spindle and means to rotate the spindle.

The first subassembly includes a first housing providing a recess in its inner surface and secured to one side of the door. A track plate is seated in the recess and has a central aperture and elongated slots diametrically spaced from the aperture and extending oppositely therefrom in diametrical alignment. A pair of mounting studs are slidably seated in the slots, and means coupling the mounting studs causes the studs to remain equidistant from the aperture during their sliding movement in the slots and to maintain them in assembly with the track plate during installation.

The second subassembly includes a second housing providing a recess in its inner surface and secured to the other side of the door. A mounting plate is disposed in the recess and has a central aperture and elongated slots diametrically spaced from the aperture and extending oppositely therefrom in diametrical alignment. A pair of fasteners are slidably seated in the slots and engaged with the studs of the first subassembly, and at least one of the housings has an aperture therein aligned with the apertures in the plates. The spindle extends through the aligned apertures of the housing and the plates, and the manipulatable means is movably supported on the at least one housing and engaged with the spindle to effect rotation thereof.

Generally, the coupling means comprises a ribbon spring slidably seated in the recess of the first housing and has its ends engaged with the studs. Preferably, the first housing includes means for guiding the sliding movement of the ribbon spring, and the first housing also has a post adjacent one end thereof about which the spring extends. Desirably, a loop is provided on each end of the ribbon spring in which the studs are seated.

Generally, both of the housings have apertures therein and the spindle extends through the aligned apertures of both housings and the plates. Manipulatable means are engaged on both ends of the spindle to effect rotation thereof. The second subassembly includes a second pair of fasteners engaging the second housing.

DETAILED DESCRIPTION OF THE PREFERRED EMBODIMENT

Figure 1:
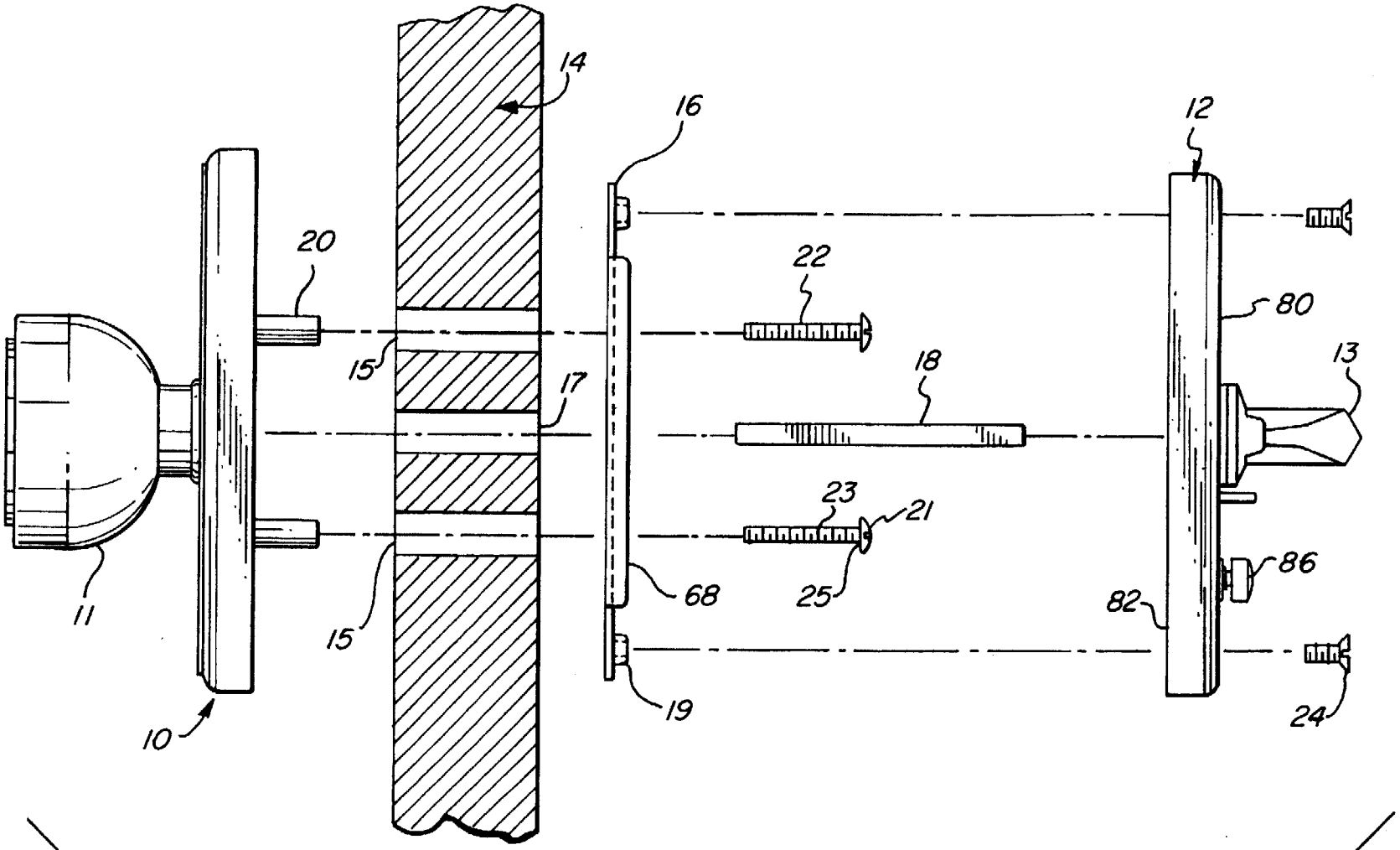
FIG. 1 is a partially exploded side elevational view of universally adjustable latch embodying the present invention positioned to be mounted on a fragmentarily illustrated door in section.

Turning first to FIG. 1, therein fragmentarily illustrated in section is a door generally designated by the numeral 14 through which extend latch mounting holes 15 and a spindle hole 17 centered therebetween. A latch assembly embodying the present invention includes the knob housing subassembly generally designated by the numeral 10 which is mounted on one side of the door 14 and a latch housing subassembly generally designated by the numeral 12 which is mounted on the other side of the door 14.

Figure 4:
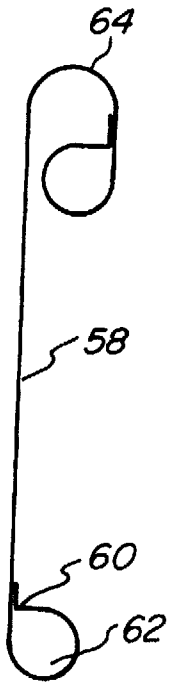
FIG. 4 is a plan view of the ribbon spring.
Figure 3:
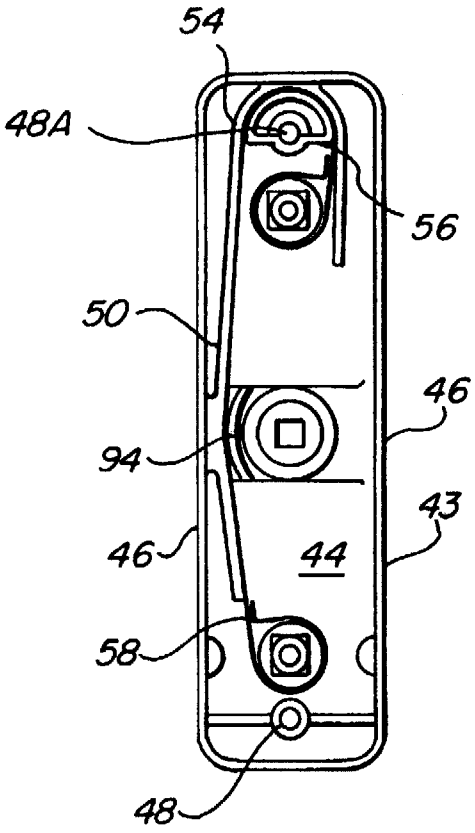
FIG. 3 is a plan view of the knob housing assembly with the track plate removed to show the mounting studs seated in the loops of the ribbon spring.
Figure 2:
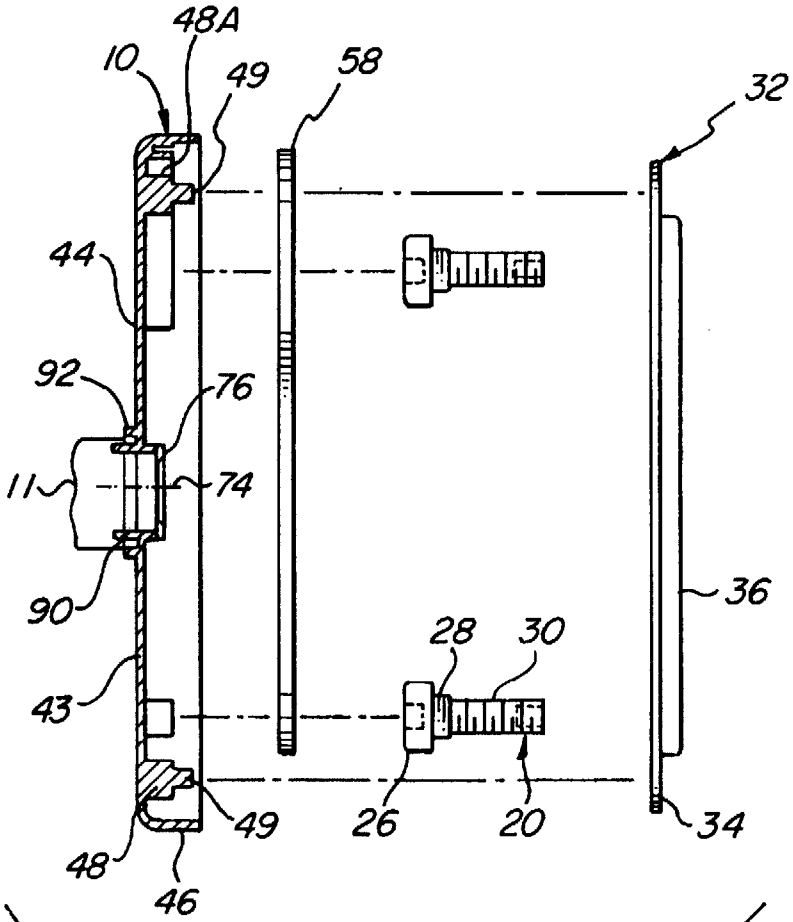
FIG. 2 is an exploded sectional view of the knob housing assembly of the latch of FIG. 1.

As illustrated in FIGS. 2–4, the knob subassembly 10 includes a face plate housing generally designated by the numeral 43 a ribbon spring 58, a pair of mounting studs 20 and a track plate 32. The face plate housing 4, has an planar wall 44 and a side wall 46 extending about the periphery thereof to provide a recess in its inner surface facing the door 14.

On its inner surface are a pair of posts 48 with protecting pins 49 on their ends. A longitudinally extending guide wall 50 terminates at one end in a U-shaped guide wall 54 which cooperates with a semicircular guide wall 56 extending about the post **48*a* to define a channel therebetween. At the center of the planar wall 44 is a cylindrical wall 90 which extends on both surfaces thereof, and a relatively short cylindrical wall 92 is spaced outwardly thereof on the outer surface of the wall 44. The wall 90 provides a cup-shaped recess on the outer surface of the housing 43 in which the knob 11 is seated. An aperture 74 for the spindle 18 is provided in the transverse wall 76 at the inner end of the wall 90. An arcuate guide wall 94 is provided on the inner surface of the housing between the wall 90 and guide wall 50** to provide a channel therebetween.

Turning next to the track plate 32, it is cooperatively configured and dimensioned to seat snugly in the recess with an elongated planar wall 34 and stiffening flanges 36 along its sides. It has a pair of apertures 42 adjacent its ends so that it seats upon the posts 48 with the pins 49 extending therethrough. It is secured in the housing by staking the pins 49, or by clips or another suitable means affixed to the pins. At its center is an aperture 40, and a pair of elongated slots 38 are spaced and extend diametrically oppositely therefrom.

Seated in the slots 38 are the mounting studs 20 which have a T-shaped profile with a disc shaped head 26 and square flats 28 therebelow, and elongated internally threaded shanks 30. The flats 28 slide along the sides of the slots 38.

As seen in FIGS. 2 and 4, the ribbon spring 58 has loops 62 formed at both ends with end flats 60 which may be soldered, riveted or otherwise secured to the body of the spring to hold the loop shape. As seen in FIG. 2, the loops 62 are disposed about the heads 26 of the studs 20, and the end portion 64 extends in the channel between the guide surfaces 54, 56. The body of the spring 58 bears on the guide wall 50 and passes through the channel between the guide walls 50, 94. As a result, movement of either of the studs 20 in its slots 38 will produce equivalent movement of the other stud 20 in its slot 38 to maintain them equidistantly spaced from the central aperture 40. The spring 58 also retains the studs in position on the track plate 32 during installation.

The latch housing subassembly 12 has a face plate housing 80 with a peripheral wall 82 bounding a recess in which are disposed the latch mounting plate 16 and fasteners 22.

Figure 6:
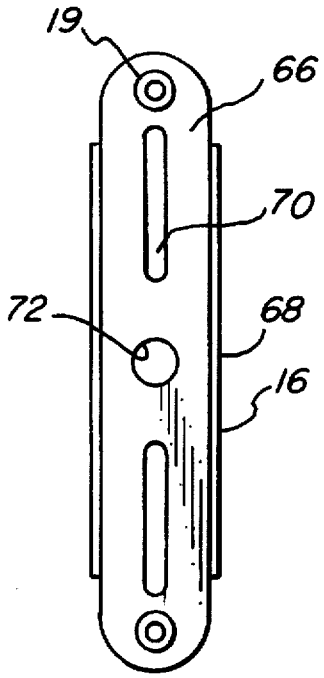
FIG. 6 is a plan view of the latch mounting plate.
Figure 5:
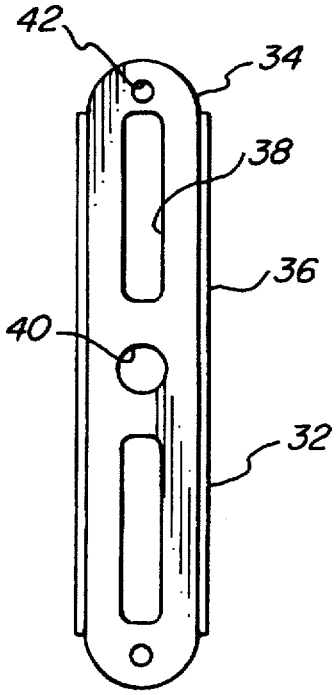
FIG. 5 is a plan view of the track plate.

As illustrated in FIG. 6, the latch mounting plate 16 includes an elongated planar wall 66 with a pair of stiffening flanges 68 extending along the sides thereof. The mounting plate 16 has a central circular aperture 72 and a pair of elongated slots 70 diametrically spaced from the central aperture 72 and extending oppositely therefrom in diametrical alignment.

Adjacent the ends of the planar wall 66 are a pair of internally threaded bosses 19 which seat the fasteners 24 to secure the face plate housing 80 to the mounting plate 16. The externally threaded fasteners 22 are slidably seated in the slots 70 and extend into the holes 15 in the door 14 and threadably engage in the mounting studs 20.

Also seen in FIG. 1 are the conventional latch operating handle 13 and latch lock 86, and the spindle 18 extends through the hole 17 in the door 14 and couples the handle 13 and knob 11. Not seen is the conventional latch arm which is pivotable by the spindle 18.

In assembling the latch to the door 14, the knob subassembly 10 is first located adjacent the surface of the door 14 and the studs 20 moved in the slots 38 to a position in which they are aligned with the holes 15 and they and the spindle 18 are then inserted into the holes 15, 17 to seat the knob subassembly 10 against the outer face of the door 14. The latch mounting plate 16 is then placed against the inner face of the door 14 and the fasteners 22 are inserted into the holes 15 and threadably engaged in the studs 20. The latch face plate housing 80 is then seated over the mounting plate 16 and the fasteners 24 are threadably engaged in the threaded bosses 19 to secure the housing 80 firmly to the door.

As can be seen, the coupling ribbon connects or couples the two mounting studs together to keep them in diametrical alignment about the center aperture 40 where they are being positioned and ensures that the mounting studs remain in assembly with the track plate 32 during installation of the knob subassembly. This selective adjustability feature enables the facile vertical adjustment of the mounting studs to achieve the desired hole mounting positions typically in the spacing range between 1½" to 3 inches".

As will be appreciated, various materials may be employed for the fabrication of the latch. Most conveniently, the knob and latch housing assemblies are metal castings which can be cast with a decorative textured or patterned surface. The spring is generally made of spring steel, and the track and latch mounting plates are fabricated from steel sheet.

Thus, it can be seen from the foregoing detailed description and accompanying drawings that the novel universally adjustable latch assembly of the present invention is one which allows simple installation on doors having a range of spacing for their existing mounting holes, and yet it is quickly and easily installed by a homeowner. Moreover, the latch assembly may be readily and economically fabricated for a large variety of doors.

Having thus described the invention, what is claimed is:

1. A universal door latch adapted to be mounted on doors having opposite sides and a series of holes therethrough for a latch spindle and fasteners comprising:

(a) a first subassembly including (i) a first housing providing a recess in its inner surface and adapted to be secured to one side of the door, (ii) a track plate seated in said recess and having a central aperture and elongated slots diametrically spaced from said aperture and extending oppositely therefrom in diametrical alignment, (iii) a pair of mounting studs slidably seated in said slots, (iv) means coupling said mounting studs whereby said studs remain equidistant from said aperture during sliding movement thereof in said slots;

(b) a second subassembly including (i) a second housing providing a recess in its inner surface and adapted to be secured to the other side of the door, (ii) a mounting plate disposed in said recess and having a central aperture and elongated slots diametrically spaced from said aperture and extending oppositely therefrom in diametrical alignment, (iii) a pair of fasteners slidably seated in said slots and engaged with said studs of said first subassembly, at least one of said housings having an aperture therein aligned with said central apertures in said plates;

(c) a spindle extending through said aligned apertures in said at least one housing and in said plates; and (d) manipulatable means movably supported on said at least one housing and engaged with said spindle to effect rotation thereof.

2. The universal door latch assembly in accordance with claim 1 wherein said coupling means comprises a ribbon spring slidably seated in said recess of said first housing and having its ends engaged with said studs.

3. The universal door latch assembly in accordance with claim 2 wherein said first housing has a post adjacent one end thereof about which said spring extends.

4. The universal door latch assembly in accordance with claim 3 wherein said first housing also includes means for guiding the sliding movement of said ribbon spring.

5. The universal door latch assembly in accordance with claim 2 wherein a loop is provided on each end of said ribbon spring seating said studs therein.

6. The universal door latch assembly in accordance with claim 1 wherein each of said first and second housings has an aperture therein aligned with said central apertures of said plates and said spindle extends through said aligned apertures in said first and second housings and in said plates, and wherein manipulatable means are engaged on both ends of said spindle to effect rotation thereof and are movably supported on said housings.

7. The universal door latch assembly in accordance with claim 1 wherein said second subassembly includes a second pair of fasteners engaging said second housing with said mounting plate.

8. A universal door latch adapted to be mounted on doors having opposite sides and a series of holes therethrough for a latch spindle and fasteners comprising:

(a) a first subassembly including (i) a first housing providing a recess in its inner surface and adapted to be secured to one side of the door, (ii) a track plate seated in said recess and having a central aperture and elongated slots diametrically spaced from said aperture and extending oppositely therefrom in diametrical alignment, (iii) a pair of mounting studs slidably seated in said slots, (iv) a ribbon spring slidably seated in said bracket of said first housing and having its ends engaged with said studs, said spring providing a loop on each end thereof, seating said studs therein, whereby said studs remain equidistant from said aperture during sliding movement thereof in said slots, (v) said first housing having a post adjacent one end thereof about which said spring extends;

(b) a second subassembly including (i) a second housing providing a recess in its inner surface and adapted to be secured to the other side of the door, (ii) a mounting plate disposed in said recess and having a central aperture and elongated slots diametrically spaced from said aperture and extending oppositely therefrom in diametrical alignment, (iii) a pair of fasteners slidably seated in said slots and engaged with said studs of said first subassembly, at least one of said housings having an aperture therein aligned with said central apertures in said plates;

(c) a spindle extending through said aligned apertures in said at least one housing and in said plates; and (d) manipulatable means movably supported on said at least one housing and engaged with said spindle to effect rotation thereof.

9. The universal door latch assembly in accordance with claim 8 wherein said first housing also includes means for guiding the sliding movement of said ribbon spring.

10. The universal door latch assembly in accordance with claim 8 wherein each of said first and second housings has an aperture therein aligned with said central apertures of said plates and said spindle extends through said aligned apertures in said housings and in said plates, wherein manipulatable means are engaged on both ends of said spindle to effect rotation thereof and are movably supported on said first and second housings, and wherein said second subassembly includes a second pair of fasteners engaging said second housing with said mounting plate.

11. A door assembly including:

(a) a door having opposite sides and a series of holes therethrough;

(b) a door latch mounted on said door over said series of holes and including (i) a first subassembly mounted on one side of said door and including (A) a first housing providing a recess in its inner surface and secured to said one face of said door, (B) a track plate seated in said recess and having a central aperture and elongated slots diametrically spaced from said aperture and extending oppositely therefrom in diametrical alignment, (C) a pair of mounting studs slidably seated in said slots and extending into a pair of said holes in said door, (D) means coupling said mounting studs whereby said studs remain equidistant from said aperture during sliding movement thereof in said slots;

(ii) a second subassembly mounted on the other side of said door and including (A) a second housing providing a recess in its inner surface and secured to said other face of said door, (B) a mounting plate disposed in said recess and having a central aperture and elongated slots diametrically spaced from said aperture and extending oppositely therefrom in diametrical alignment, (C) a pair of fasteners slidably seated in said slots and extending into said pair of holes in said door and engaged with said studs of said first subassembly, at least one of said housings having an aperture therein aligned with said central apertures in said plates and another of said holes in said door;

(iii) a spindle extending through said aligned apertures in said at least one housing, said plates and said another hole; and (iv) manipulatable means movably supported on said at least one housing and engaged with said spindle to effect rotation thereof.

12. The door assembly in accordance with claim 11 wherein said coupling means comprises a ribbon spring slidably seated in said recess of said first housing and having its ends engaged with said studs.

13. The door assembly in accordance with claim 12 wherein said first housing has a post adjacent one end thereof about which said spring extends.

14. The door assembly in accordance with claim 13 wherein said first housing also includes means for guiding the sliding movement of said ribbon spring.

15. The door assembly in accordance with claim 12 wherein a loop is provided on each end of said ribbon spring, and receives one of said studs therein.

16. The door assembly in accordance with claim 11 wherein each of said first and second housings has an aperture therein aligned with said central apertures of said plates and said spindle extends through said aligned apertures of said housings, said another hole, and said plates, and wherein manipulatable means are engaged on both ends of said spindle to effect rotation thereof and are movably supported on said housings.

17. The door assembly in accordance with claim 11 wherein said second subassembly includes a second pair of fasteners engaging said second housing with said mounting plate.

* * * * *